United States Patent [19]

Aldred

[11] Patent Number: 4,604,918

[45] Date of Patent: Aug. 12, 1986

[54] APPARATUS FOR APPLYING TENSION TO STUDS

[75] Inventor: Derek L. Aldred, Dipton, England

[73] Assignee: Haskel, Inc., Burbank, Calif.

[21] Appl. No.: 778,220

[22] Filed: Sep. 20, 1985

[51] Int. Cl.[4] ..... B25B 29/02

[52] U.S. Cl. ..... 81/57.38

[58] Field of Search ..... 81/57.38, 53.2; 254/29 A

[56] References Cited

U.S. PATENT DOCUMENTS

| | | | |
|---|---|---|---|
| 1,898,726 | 2/1933 | Hess | 81/53.2 |
| 4,175,453 | 11/1979 | Exner et al. | 81/57.38 |
| 4,315,446 | 2/1982 | Orban | 81/57.38 |
| 4,565,111 | 1/1986 | Ecker et al. | 81/57.38 |

FOREIGN PATENT DOCUMENTS

| | | | |
|---|---|---|---|
| 527552 | 10/1945 | United Kingdom | 81/53.2 |
| 869527 | 5/1961 | United Kingdom | 81/53.2 |

*Primary Examiner*—James L. Jones, Jr.

*Attorney, Agent, or Firm*—Pretty, Schroeder, Brueggemann & Clark

[57] ABSTRACT

A stud tensioning apparatus includes an array of arcuate jaw segments that are movable inwardly to cause grooves on the segments to engage the threads of the studs. The tensioning force is applied to the segments by a pull member that has hangers received by apertures in the segments. The hangers fit loosely into the apertures, permitting the segments to move pivotably in two perpendicular directions to compensate for misalignment between the stud and the tensioning apparatus.

16 Claims, 8 Drawing Figures

APPARATUS FOR APPLYING TENSION TO STUDS

FIELD OF THE INVENTION

The present invention relates to a tensioning apparatus for use in securing a nut to a threaded stud.

BACKGROUND OF THE INVENTION

There are many situations in which a nut must be secured to a threaded stud and a predetermined tension applied to the stud. (The term "stud" as used herein includes bolts as well as studs that are integrally formed with other structures.) As the nut becomes tighter, the frictional forces increase greatly and in most instances non-linearly. It therefore becomes more and more difficult to determine the stud tension by measuring the torque applied to the nut. A method of overcoming this difficulty is to pull the stud axially, directly applying a predetermined tension, and then turning the nut, applying only a small torque. The stud is then released, but it is held in tension by the nut.

One exemplary environment in which this stud tensioning technique is used is in making up joints in large diameter pipelines. The numerous studs in these joints must be subjected to a repeated pattern of increasing tension, each stud being tensioned in a number of successive operations. If a stud tensioning apparatus is used, it must therefore make a very large number of engagements with the studs before the job is completed. To make up a single joint may take a four or five person crew an entire shift. Not only are labor costs high but the down time may be a much greater cost.

The apparatus commonly used to tension the studs of such a joint includes a nut-like member that must be rotated to engage and disengage each stud, making the apparatus time-consuming to use. The design of such apparatus is limited by the small width of the flange on which the studs are located and the close proximity of the studs to one another. One particularly problematic design consideration arises from the fact that the studs often are not precisely perpendicular to the flange, making proper engagement of the stud threads for tensioning purposes difficult.

Devices have been proposed that would not be threaded onto the studs, but would grasp the threads of the studs by the clamping motion of a jaw. However, these devices have not been found to be satisfactory due to an inability to combine a compact structure with strength, durability, speed and ease of operation.

An objective of the present invention is to provide an improved stud tensioning apparatus that does not rely on rotation to engage the studs and that is capable of meeting the above criteria.

SUMMARY OF THE INVENTION

The stud tensioning apparatus of the present invention employs an array of jaw segments each having an inwardly facing surface with grooves thereon adapted to engage threads on a stud. Each segment has an attachment portion extending from its inwardly facing surface and defining an aperture. Preferably, the segments are arcuate and contiguous, forming a cylinder that surrounds the stud.

A pull member disposed along an axis about which the segments are arranged has a plurality of hangers projecting radially from that axis into the apertures. Preferably, the hangers fit loosely into the apertures, permitting pivotal movement of the segments in two perpendicular directions to compensate for misalignment between the pull member and the stud. In one form of the invention the apertures and the hangers are generally rectangular.

A mechanism is provided for urging the segments inwardly against the stud and confining the segments radially. Preferably this takes the form of a rotatable sleeve having an inner cam surface. The sleeve can be confined within a housing. A return spring may be included that forces the jaw segments outwardly against the sleeve.

An actuator mechanism applies an axial force to the pull member and thus to the segments and the stud. In a preferred form of the invention, this actuator mechanism takes the form of a piston, to which the pull member is secured, that is reciprocable in a hydraulic cylinder.

The apparatus may include a mechanism for rotating a nut in threaded engagement with the stud.

Other features and advantages of the present invention will become apparent from the following detailed description, taken in conjunction with the accompanying drawings, which illustrate, by way of example, the principles of the invention.

DESCRIPTION OF THE PREFERRED EMBODIMENT

Figure 2:
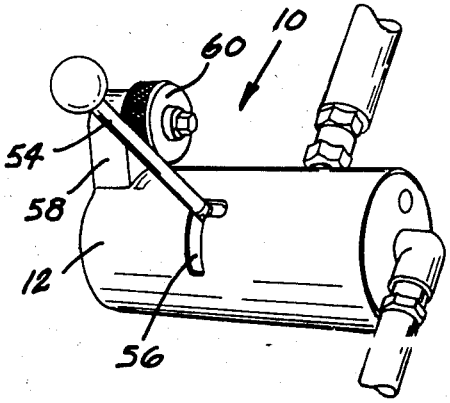
FIG. 2 is a three-dimensional pictorial illustration of the stud tensioning device.
Figure 6:
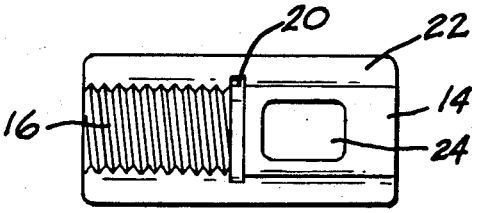
FIG. 6 is a side elevation of a single jaw segment of the device.

A stud tensioning device 10, shown in FIG. 2, includes a cylindrical housing 12 that contains a plurality of jaw segments 14, one of which is shown separately in FIG. 6. The jaw segments 14 are arranged to form a cylinder about the central axis of the housing 12, as best shown in the cross-sectional views of FIGS. 4*a* and 4*b* and the exploded view of FIG. 7. In this embodiment, there are four such segments 14.

Figure 3:
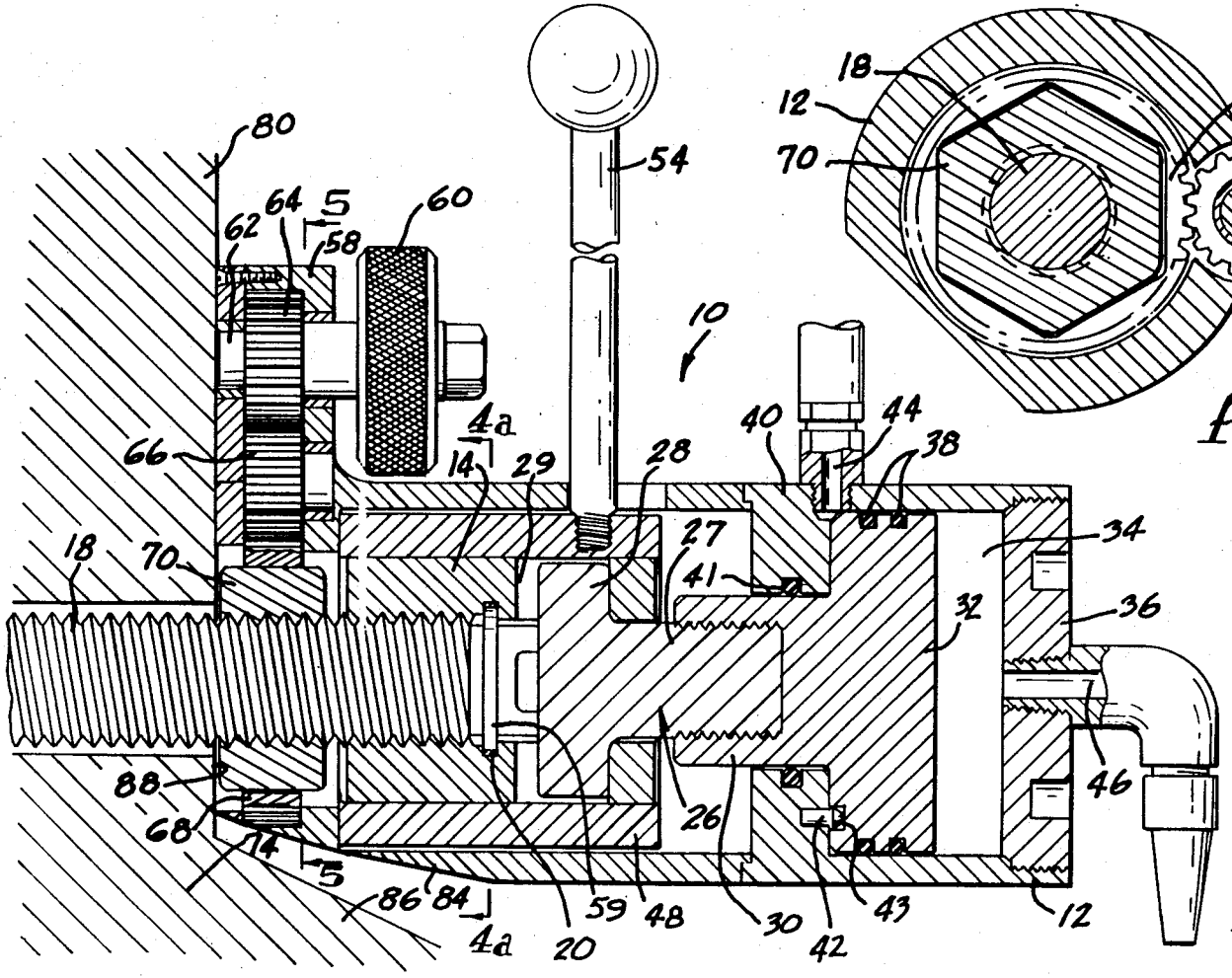
FIG. 3 is an enlarged cross-sectional view of the stud tensioning device and a fragmentary portion of a flange, along with the stud to be tensioned, taken along the line 3—3 of FIG. 1.

Each segment 14 has an inwardly facing engagement surface 16 provided with grooves that are generally transverse but set at a small spiral angle so as to be adapted to engage the threads of a stud 18, as shown in FIG. 3. At the top end of the engagement surface 16 is a transverse recess 20 that is larger and deeper than the grooves of the surface 16. When the four segments 14 are assembled contiguously to form a cylinder, the recesses 20 form a circle, as best shown in FIG. 3. Above the recess 20 and extending from the engagement surface 16, each segment 14 includes an attachment portion 22 that defines a generally rectangular aperture 24 with rounded corners, the aperture being best shown in FIGS. 6 and 7.

Figure 7:
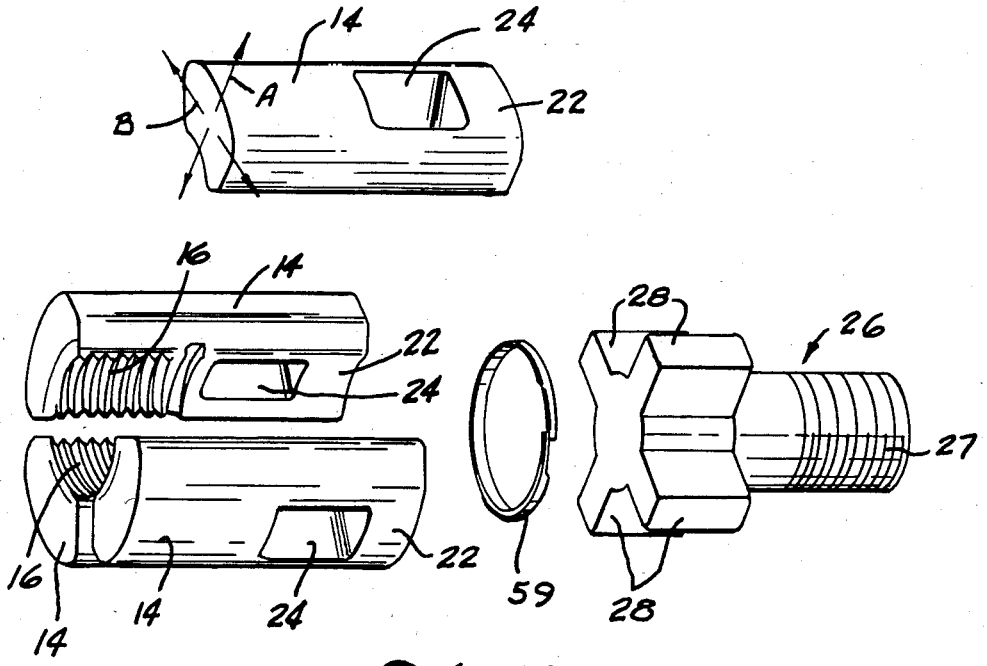
FIG. 7 is a three-dimensional exploded view of the pull member jaw segments and return spring of the device.

Positioned generally above the segments 14, as best shown in FIGS. 3 and 7, is a pull member 26. This member 26 has a cylindrical center portion 27 that is aligned with the center axis of the housing 12 and the cylinder formed by the segments 14. Projecting radially from the lower end of the pull member 26 are four equally-spaced integrally-formed hangers 28 of generally rectangular cross-section, as best shown in FIG. 7. These hangers 28, which are perpendicular to the center axis, are loosely received by the apertures 24 of the segments 14. A clearance 29 equal to at least one pitch of threads of the bolt 18 is provided between the top of the jaw segments 14 and the bottom of the pull member 26 to permit vertical adjustment of the segments for alignment with the bolt threads.

The top end of the center portion 27 of the pull member 26 is threaded and thus secured within a bore in a projection 30 that extends downwardly from the center of the bottom face of a piston 32. The piston 32 is reciprocable within an hydraulic cylinder 34 defined by the top of the housing 12 and a disk-like end plate 36. Appropriate seals 38 are carried by the piston 36. At the bottom of its stroke, the piston 32 comes into contact with an annular stop plate 40 which carries a seal 41 that engages the cylindrical outer surface of the projection 30. The stop plate 40 carries an upwardly projecting anti-rotation pin 42 received by a recess 43 in the bottom of the piston 26 when the piston is at the bottom of its stroke, thus preventing rotation of the piston and the components that reciprocate with it.

The piston 32 is driven away from the stud 18 to apply a tensioning force when hydraulic fluid is admitted through a port 44 just above the stop plate 40. The piston 32 is double-acting and is returned toward the stud 18, either hydraulically or pneumatically, by the admission of fluid through a port 46 at the center of the end plate 36.

Figure 4B:
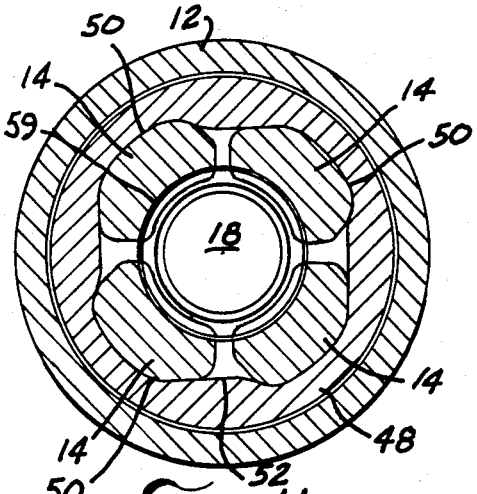
FIG. 4*b* is a transverse cross-sectional view similar to 4*a*, but showing the device in a disengaged position.
Figure 4A:
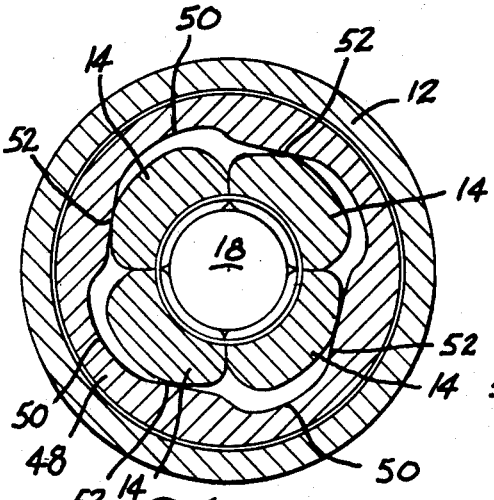
FIG. 4*a* is a transverse cross-sectional view of the stud tensioning device, taken substantially along the line 4*a*—4*a* of FIG. 3 and showing the device in its engaged position.

Disposed within the housing 12 so as to surround and radially confine the segments 14 is a rotatable sleeve 48. The inner surface of the sleeve 48 is not cylindrical but rather forms a cam surface, as best shown in FIGS. 4*a* and 4*b*, such that the inside diameter of the sleeve varies considerably depending upon the line along which it is measured. The sleeve 48 can be rotated to a disengagement position, shown in FIG. 4*b*, in which the outsides of the segments 14 fit into recesses 50 defined by the cam surface of the sleeve, thus permitting the segments 14 to move radially away from the stud 18 to the greatest extent possible. As the sleeve 48 is rotated in a counterclockwise direction from the disengagement position of FIG. 4*b* to the engagement position of FIG. 4*a*, the cam surfaces 52 adjacent to the recesses 50 push the segments 14 inwardly toward the stud 18. The grooves on the engagement surfaces 16 of the segments 14 then securely receive and interlock with the threads of the stud 18.

The apparatus 10 also includes a shift lever 54 that projects from the sleeve 48 through a slot 56 in the housing 12. The sleeve 48, can thus be rotated between the disengagement position of FIG. 4*b* and the engagement position of FIG. 4*a* by a force applied manually to the lever 54.

Disposed within the circular recess 20 defined by the segments 14 is a circular return spring 59, best shown in FIGS. 3 and 7. The spring 59 resiliently urges the segments 14 radially outwardly toward the disengagement position of FIG. 4*b*.

Figure 5:
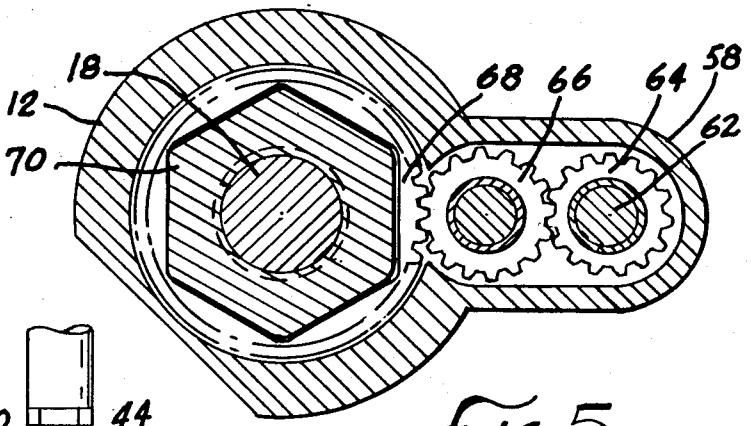
FIG. 5 is another transverse cross-sectional view taken substantially along the line 5—5 of FIG. 3.

Although the housing 12 is generally cylindrical, it includes a rounded projection 58 extending from its bottom end. An external knurled knob 60 is mounted on the projection 58, as best shown in FIGS. 2 and 3. Manual rotation of the knob 60 turns a shaft 62, thus causing rotation of a gear 64, which in turn rotates an idler gear 66 and a toothed wrench member 68, as best shown in FIGS. 3 and 5. The wrench member 68 defines a hexagonal socket at its center in which a nut 70 that threadedly engages the stud 18 is received. Accordingly, the nut 70 can be rotated and caused to move axially along the stud 18 by turning the knob 60.

Figure 1:
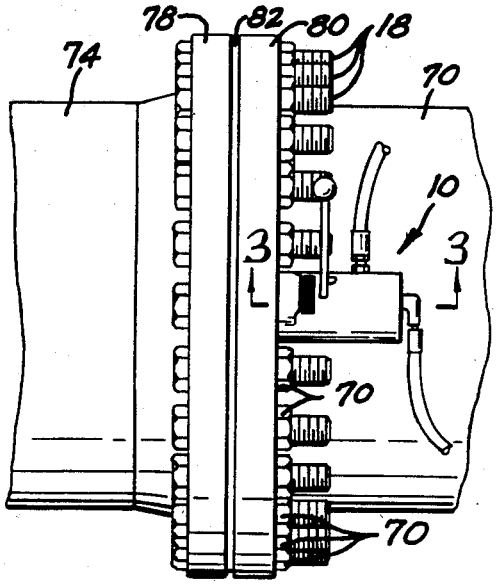
FIG. 1 shows a stud tensioning device, constructed in accordance with the present invention, positioned for use in connection with a pipeline joint.

The operation of the device 10 will now be explained with reference to the pipeline joint illustrated in FIG. 1. Two pipeline sections 74 and 76 carry mating flanges 78 and 80, respectively, which come together with a ring-shaped seal 82 between them. A large number of studs 18 in the form of bolts project through the flanges 78 and 80, the studs being closely spaced and arrayed in a circular configuration. Each stud 18 carries a nut 70. To make up a joint between the two pipe sections 74 and 76, and properly seat the seal 82, it is necessary to tension the studs 18 in a predetermined pattern. As is well known to persons skilled in this art, it is not possible to tension any one stud fully in a single operation. Rather, each stud must have its tension increased by a small incremental amount each time the pattern is repeated.

To increase the tension on a chosen stud 18, the apparatus 10 is placed over that stud 18 so that the corresponding nut 70 is received by the wrench member 68. As best shown in FIG. 3, the pipe section 74 tapers outwardly where it meets its integrally-formed flange 80. Therefore, the housing 12 is cut away to form an inclined flat portion 84 at its lower end, which accommodates the enlarged portion 86 of the section 74.

When the apparatus 10 is first positioned over the stud 18, the segments 14 must be in their disengagement position illustrated in FIG. 4*b*, so that the grooves on the engagement surfaces 16 of the segments do not engage the threads of the stud. For this reason, the shift lever 54 must be pushed fully to its most counterclockwise position so that the segments 14 fit into the recesses 50 defined by the sleeve 48. It should be noted that the return spring 59 pushes the segments 14 outwardly into the recesses 50 so that the segments do not prematurely engage the stud 18.

Once the apparatus 10 has been positioned over the stud 18, the shift lever 54 is moved clockwise to the position shown in FIG. 2, thereby rotating the sleeve 48 to the engagement position, shown in FIG. 4*a*, in which the cam surfaces 52 force the segments 14 inwardly. The pin 42 prevents the segments 14 from rotating with the sleeve 48. The grooves of the engagement surfaces 16 thus interlock with the threads of the stud 18. At this point, the arcuate segments 14, which are then contiguous, are held in position not only by their engagement with the sleeve 48 but by their abutment against each other, so that they form a cylinder fully encircing the stud 18. It should be noted, however, that the central axis of the apparatus 10 is not always precisely aligned with the stud 18. It is desirable for the apparatus 10 to include some provision for compensating for this type of misalignment. For this reason it is important that the apertures 24 are slightly larger than the hangers 28 that they receive. The segments 14 are therefore able to pivot on the hangers 28 in two perpendicular directions. That is, they can pivot so that their lower ends swing toward and away from the stud 18 (arrow A in FIG. 7) and they can pivot from side to side (arrow B in FIG. 7) without moving toward or away from the stud 18. In addition, the allowances between the hangers 28 and the sides of the apertures 24 permit a small axial movement of the segments to align the grooves of the engagement surfaces 16 with the threads of the studs 18.

Once the segments 14 are fully engaged with the stud 18, hydraulic fluid is admitted through the port 44, forcing the piston 32 to move within the cylinder 44 and causing the pull member 28 to move the segments 14 and the stud 18 axially away from the flange 80. This creates a small gap 88 between the nut 70 and the flange 80 as the stud 18 is stretched. The nut 70 is then turned, causing it to move axially along the stud 18 until it engages the flange 80. The hydraulic pressure is then released. The shift lever 54 is then moved, rotating the sleeve 48 so that the segments 14 disengage the stud 18, allowing the apparatus 10 to be removed from that stud and placed over a different stud. Of course, the same apparatus 10 can be used to reduce the tension on a stud if the nut 70 is rotated in the opposite direction while the stud 18 is held in tension, after which the stud 18 is released.

While a particular form of the invention has been illustrated and described, it will be apparent that various modifications can be made without departing from the spirit and scope of the invention.

I claim:

1. A stud tensioning apparatus comprising:

an array of jaw segments, each having an inwardly facing engagement surface with grooves thereon adapted to engage threads on said stud, each of said segments having an attachment portion extending away from said surface and defining an aperture therein;

a pull member disposed along an axis about which said segments are arranged and having a plurality of hangers projecting radially from said axis into said apertures;

radial confinement means for urging said segments inwardly against said stud; and actuator means for applying an axial tensioning force to said pull member and thus to said segments and said stud.

2. The apparatus of claim 1 wherein said segments are arcuate and contiguous.

3. The apparatus of claim 1 further comprising means for resiliently urging said segments radially apart.

4. The apparatus of claim 1 wherein said radial confinement means comprises a rotatable sleeve surrounding said segments and having a cam surface on the inside thereof.

5. The apparatus of claim 1 wherein said hangers fit loosely within said apertures, permitting pivotal movement of said segments in two perpendicular directions to compensate for misalignment between said pull member and said stud.

6. The apparatus of claim 5 wherein said apertures and said hangers are generally rectangular.

7. The apparatus of claim 1 further comprising means for rotating a nut in threaded engagement with said stud.

8. The apparatus of claim 1 wherein said actuator means comprises a hydraulic cylinder and piston.

9. The apparatus of claim 1 wherein said jaw segments are arcuate and combine to form a cylinder surrounding said stud.

10. A stud tensioning apparatus comprising:

a housing;

an array of contiguous arcuate jaw segments disposed within said housing and forming a cylinder surrounding said stud, each of said segments having inwardly facing engagement surfaces with grooves thereon adapted to engage threads on said stud and an attachment portion extending from said surface and defining an aperture therein;

a pull member disposed along an axis about which said segments are arranged and having a plurality of hangers projecting radially from said axis into said apertures, said hangers fitting loosely within said apertures to permit pivotal movement of said segments in two perpendicular directions to compensate for misalignment between said pull member and said stud;

radial confinement means for urging said segments radially inwardly against said stud, said confinement means comprising a sleeve disposed within said housing and surrounding said segments and having a cam surface on the inside thereof;

actuator means for applying an axial tensioning force to said pull member and thus to said segments and said stud; and means mounted on said housing for rotating a nut in threaded engagement with said stud.

11. The apparatus of claim 10 further comprising means for resiliently urging said segments radially apart.

12. The apparatus of claim 10 wherein said inner surfaces of said segments define a circular recess, said apparatus further comprising return spring means disposed within said recess for urging said segments outwardly against said sleeve.

13. The apparatus of claim 10 wherein said actuator means comprises an hydraulic cylinder and a piston.

14. The apparatus of claim 10 wherein said actuator means comprises a piston to which said pull member is secured and an hydraulic cylinder in which said piston is reciprocable.

15. The apparatus of claim 10 wherein said apertures and said hangers are generally rectangular.

16. A stud tensioning apparatus comprising:

a housing;

an array of four contiguous arcuate jaw segments disposed within said housing and forming a cylinder surrounding said stud, each of said segments having an inwardly facing engagement surface defining grooves adapted to engage the threads on said studs and defining a spring receiving recess, and each of said segments having an attachment portion extending from said surface and defining a rectangular aperture therein;

a pull member disposed along an axis about which said segments are arranged and having four hangers of rectangular cross-section projecting radially from said axis into said apertures, said hangers fitting loosely within said apertures to permit pivotal movement of said segments in two perpendicular directions to compensate for misalignment between said pull member and said stud;

radial confinement means for urging said segments radially inwardly against said stud, said confinement means comprising a sleeve disposed within said housing and surrounding said segments and having a cam surface on the inside thereof;

actuator means for applying an axial force to said pull member and thus to said segments and said stud, said actuator means comprising a piston in which said pull member is received and an hydraulic cylinder in which said piston is reciprocable; and means mounted on said housing for rotating a nut in threaded engagement with said stud.

* * * * *